US007975892B2

(12) United States Patent
Yeh

(10) Patent No.: US 7,975,892 B2
(45) Date of Patent: Jul. 12, 2011

(54) MAGAZINE FRONT END RETAINING STRUCTURE FOR HAMMER TACKER

(75) Inventor: Larry Yeh, Taoyuan Hsien (TW)

(73) Assignee: Great-Elite Industrial Co., Ltd., Taoyuan Hsien (TW)

( * ) Notice: Subject to any disclaimer, the term of this patent is extended or adjusted under 35 U.S.C. 154(b) by 151 days.

(21) Appl. No.: 12/538,477

(22) Filed: Aug. 10, 2009

(65) Prior Publication Data

US 2011/0031295 A1 Feb. 10, 2011

(51) Int. Cl.
*B25C 1/06* (2006.01)

(52) U.S. Cl. ..... 227/133; 227/134

(58) Field of Classification Search ..... 227/132, 227/129, 120, 147, 133, 134
See application file for complete search history.

(56) References Cited

U.S. PATENT DOCUMENTS 2,342,818 A * 2/1944 Polzer ..... 227/126
2,552,798 A * 5/1951 Lindstrom ..... 227/133
2,664,565 A * 1/1954 Percoco ..... 227/120
2,667,639 A * 2/1954 Schick ..... 227/138
2,896,210 A * 7/1959 Rubin ..... 227/133
3,113,317 A * 12/1963 Carlson, Sr. et al. ..... 227/128
3,129,430 A * 4/1964 Latschbacher ..... 227/113
6,179,194 B1 * 1/2001 Morton ..... 227/133
6,863,204 B2 * 3/2005 Lu ..... 227/109
7,481,346 B2 * 1/2009 Vanden Berg et al. ..... 227/147

* cited by examiner

*Primary Examiner* — Scott A. Smith
(74) *Attorney, Agent, or Firm* — Rabin & Berdo, PC

(57) ABSTRACT

A magazine front end retaining structure for hammer tacker includes a case body head cap connected to a front end of a case body of a tacker case of the hammer tacker; a retaining push member pivotally mounted to a front opening of the case body head cap; an outer staple channel head cap connected to a front end of an outer staple channel of a magazine, which and a magazine cover are coaxially pivotally connected at respective rear end to a rear end of the case body, and a catch section located at a front end of the outer staple channel head cap for the retaining push member to hook thereto, so that a front end of the magazine is held to the tacker case. To release the front end of the magazine from the tacker case for loading staples, simply pushes the retaining push member with one hand.

10 Claims, 12 Drawing Sheets

MAGAZINE FRONT END RETAINING STRUCTURE FOR HAMMER TACKER

FIELD OF THE INVENTION

The present invention relates to a hammer tacker, and more particularly to a magazine front end retaining structure for hammer tacker that allows a user to conveniently release a front end of a magazine of the hammer tacker from a tacker case for loading staples simply by push a retaining push member with one hand.

BACKGROUND OF THE INVENTION

In a conventional hammer tacker as shown in FIGS. 1 to 3, there is a retaining structure 10 for normally retaining a front end of a magazine 12 to a case of the hammer tacker. The retaining structure 10 includes a pair of slots 110 provided at a front end of a magazine cover 11, a locating pin 111 horizontally slidably disposed in and across the slots 110, and an immovable striking plate 112 located in front of the slots 110 to prevent the locating pin 111 from sliding out of the slots 110, so that the locating pin 111 is confined in the slots 110 by the immovable striking plate 112.

The retaining structure 10 further includes two hooking structures 121 separately formed at two lateral sides of the magazine 12 corresponding to the slots 110. Each of the hooking structures 121 includes a hook section 122 and a locating slot 123 sized corresponding to the locating pin 111. The hook section 122 has a forward slope 124 located above the locating slot 123, so that the locating pin 111 can easily slide into the locating slots 123 via the slopes 124.

To load staples onto the conventional hammer tacker for use, the locating pin 111 must first be pushed out of the slots 110 of the magazine cover 11 to a stop face of the magazine 12, and then the magazine 12 is downward separated from the magazine cover 11. The above-described retaining structure 10 for the conventional hammer tacker has the following disadvantages: (1) a user has to use two hands to safely push the locating pin 111 and separate the magazine 12 from the magazine cover 11 for loading the staples; (2) the hooking structure 121 has insufficient structural strength; and (3) any touch of the locating pin 111 during operating the conventional hammer tacker tends to undesirably separate the magazine 12 from the magazine cover 11.

Therefore, it is desirable to improve the conventional hammer tacker to eliminate the disadvantages thereof.

SUMMARY OF THE INVENTION

A primary object of the present invention is to provide a magazine front end retaining structure for hammer tacker that allows a front end of a magazine of a hammer tacker to be conveniently released from a tacker case for loading staples simply by pushing a retaining push member with one hand.

To achieve the above and other objects, the hammer tacker according to the present invention includes a handgrip, a tacker case having a case body, a rear end of which having a partial length fixedly fitted into a receiving space of the handgrip, a magazine cover, and a magazine; the magazine cover and the magazine being coaxially pivotally connected at respective rear end to the rear end of the case body near the handgrip; and the magazine front end retaining structure includes a striking member being provided in the case body near a front end thereof, and the magazine cover having a front end opposite to the handgrip being forward extended through and held to the striking member; a case body head cap being connected to and enclosing the front end of the case body, and defining an opening structure at a front end thereof; a retaining push member being mounted to the opening structure of the case body head cap to bear against the striking member; and a catch section being provided to a front end of the magazine opposite to the handgrip, and the retaining push member correspondingly hooking to the catch section to thereby retain the front end of the magazine to the tacker case.

The striking member includes a locating plate for fixedly connecting to the case body and the case body head cap, and a striking plate engaged with and held to the locating plate. The locating plate includes a mount section adjacent and locked to the case body, and a stop section located at a front end of the mount section. The striking plate is internally provided with a limiting slot, through which the stop section of the locating plate is forward extended.

The retaining push member includes a retaining push plate and a first elastic element, and the first elastic element has two ends separately pressed against the retaining push plate and the striking member. The retaining push plate has a push section, at where one end of the first elastic element is pressed against the retaining push plate. The push section has a lower end being extended to form a hook section, and is provided at two lateral sides with two mounting brackets for connecting to the case body head cap.

The case body is internally provided near a central portion thereof with a leaf spring, and two opposite ends of the leaf spring are separately pressed against the case body and a top of the magazine cover.

The magazine cover is provided at the rear end with a holding section to connect to an end of a second elastic element, and at the front end with a forward projected insertion section to extend through and be confined in the striking member. A pin is extended across the front end of the magazine cover behind the projected insertion section. Another end of the second elastic element passes the pin to connect to the magazine. The magazine cover is further provided at each of two lateral sides with a sidewardly outward extended pressure receiving section.

The magazine includes an outer staple channel, an inner staple channel received in the outer staple channel, an outer staple channel head cap located at a front end of the outer staple channel opposite to the handgrip for catching the retaining push member and thereby being held in place by the retaining push member, and a slide unit fitted on a top of the inner staple channel received in the outer staple channel to connect to the other end of the second elastic element.

The outer staple channel and the magazine cover are coaxially pivotally connected at respective rear end to the rear or handgrip end of the case body. The outer staple channel internally defines an elongated space being sized corresponding to the staples used with the hammer tacker, and is provided at positions corresponding to the two pressure receiving sections of the magazine cover with two upward projected pressing sections.

The outer staple channel head cap is connected to and encloses the front end of the outer staple channel opposite to the handgrip and cooperates with the outer staple channel to define a staple feeding gap between them. The outer staple channel head cap includes a stopper section corresponding to a front open end of the elongated space. The catch section is located at an upper end of the stopper section to forward extend therefrom for catching the retaining push member. A connection section is provided at two lateral sides of the stopper section for correspondingly connecting to the outer staple channel.

In a preferred embodiment, the catch section includes two forward projected lugs, to which the retaining push member hooks to hold a front end of the magazine to the tacker case.

The inner staple channel is received in the elongated space defined in the outer staple channel, such that two narrow spaces are formed between two lateral walls of the inner staple channel and two lateral walls of the outer staple channel. Two slide ways are symmetrically formed on an outer face of the two lateral walls of the inner staple channel.

The slide unit is fitted on a top of the inner staple channel received in the elongated space in the outer staple channel, and is connected to the other end of the second elastic element. The slide unit includes a drive section configured corresponding to the staples being used with the hammer tacker, and two rails provided along two lower inner edges of the drive section. The rails are slidably engaged with the two slide ways on the inner staple channel to limit the drive section to displace along the slide ways, and the rails are brought by a pulling stress of the second elastic element to displace horizontally in the slide ways.

Briefly speaking, the present invention is characterized in that the tacker case includes the case body and the case body head cap, and the case body head cap defines the opening structure for the retaining push member to mount thereto; and that the magazine is provided at the front end with the catch section for engaging with the retaining push member; and that the catch section can be disengaged from the retaining push member to release the front end of the magazine from the tacker case simply by pushing the retaining push member. Therefore, the hammer tacker can be more conveniently and easily operated to open the magazine for loading staples with only one hand.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
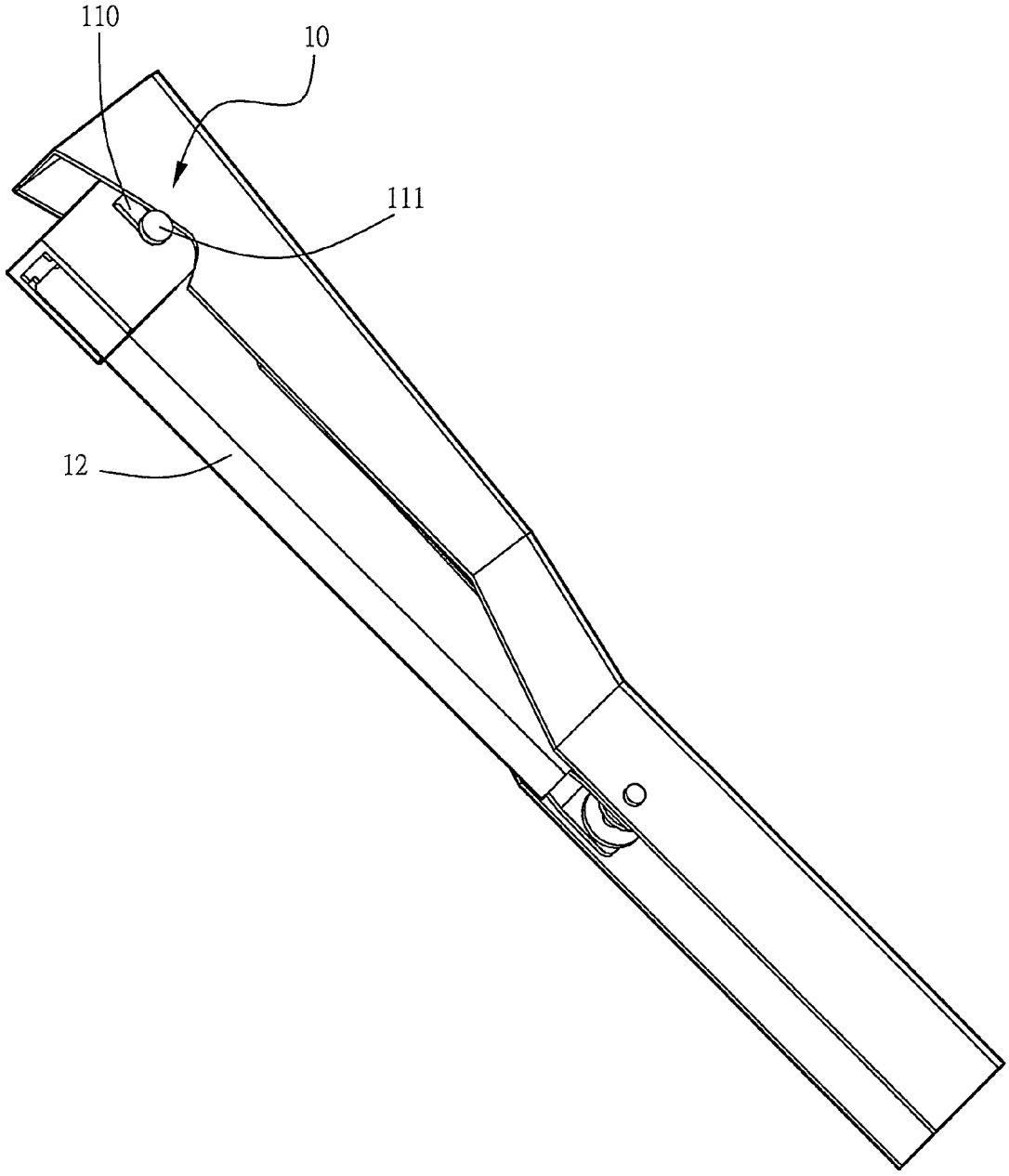
FIG. 1 (Prior Art)
FIG. 1 is a perspective view of a conventional hammer tacker.
Figure 2:
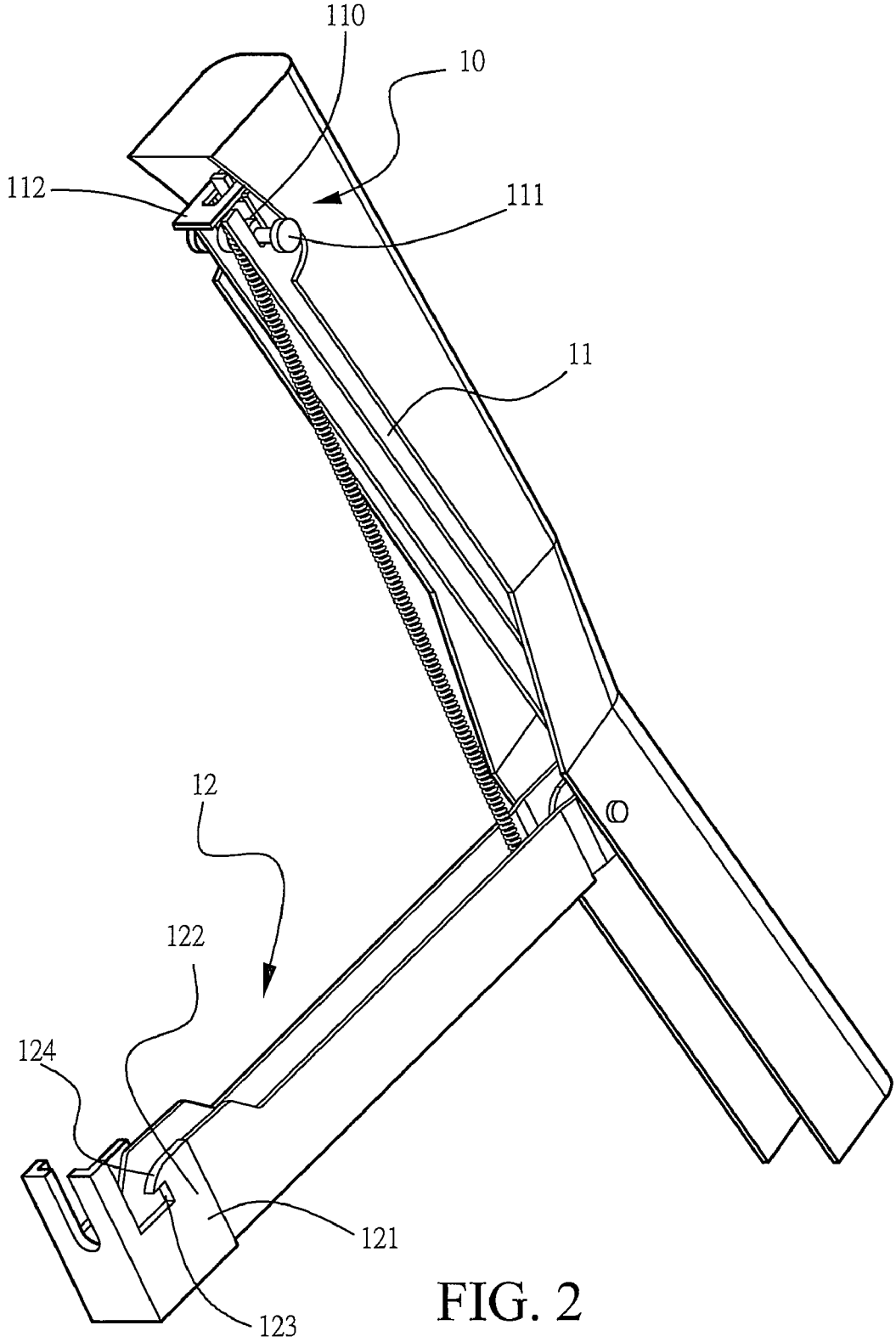
FIG. 2 (Prior Art)
FIG. 2 shows the conventional hammer tacker of FIG. 1 with a magazine pivotally turned to an open position.
Figure 3:
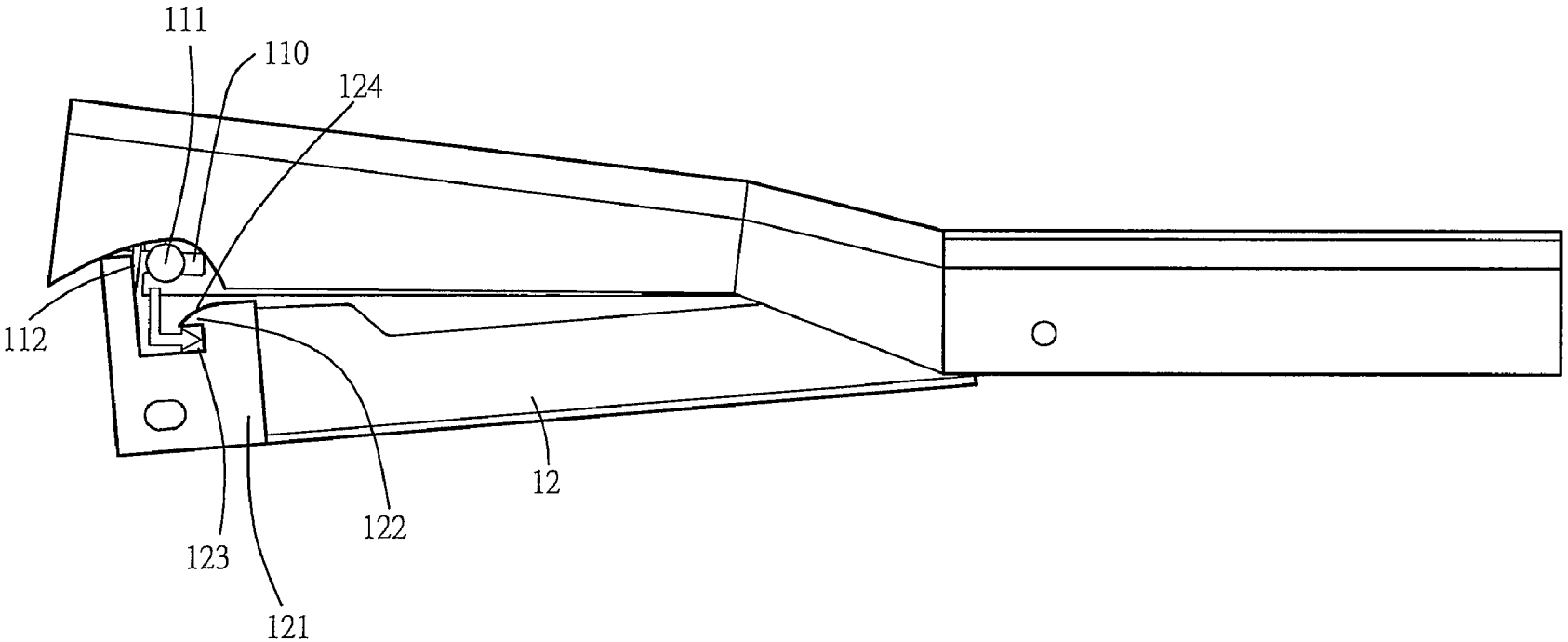
FIG. 3 (Prior Art)
FIG. 3 is a side view of the conventional hammer tacker of FIG. 1 with the magazine in a closed position.
Figure 4:
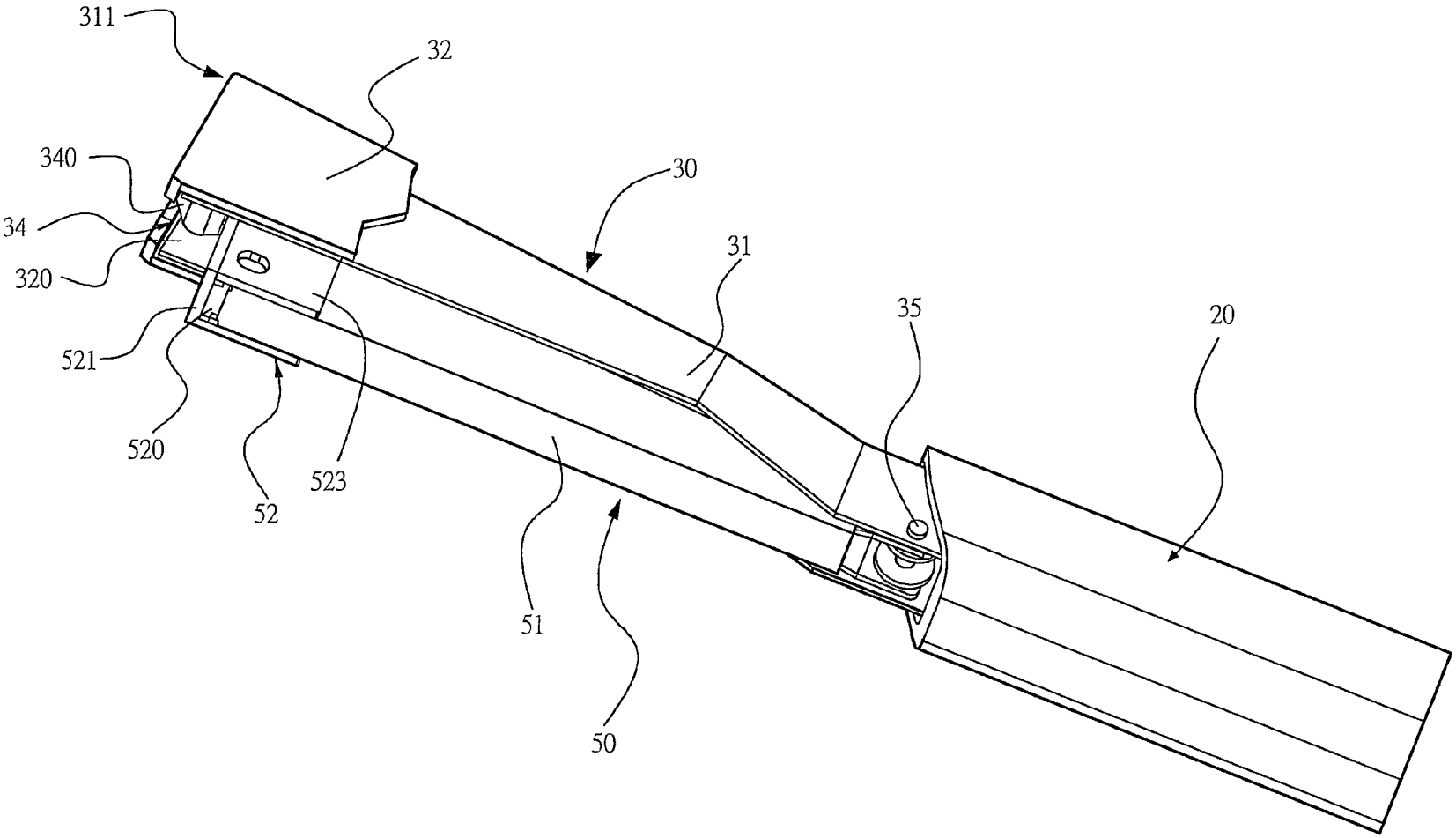
FIG. 4 is a perspective view of a hammer tacker according to a preferred embodiment of the present invention.
Figure 5:
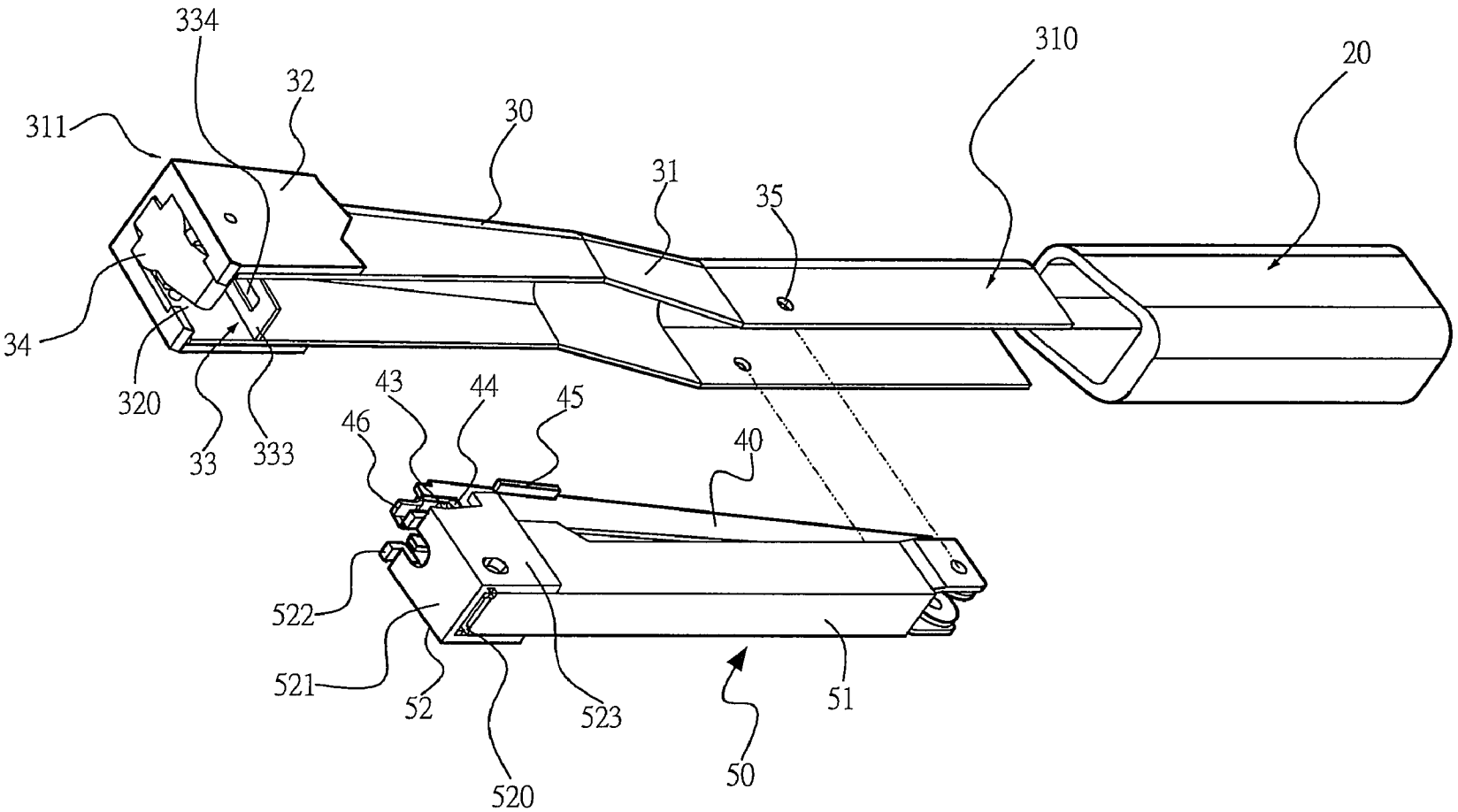
FIG. 5 is a partially exploded perspective view of FIG. 4.

Please refer to FIGS. 4 and 5. The present invention relates to a magazine front end retaining structure for hammer tacker. The hammer tacker according to a preferred embodiment of the present invention includes a handgrip 20, a tacker case 30 having a rear end, a partial length of which being fixedly fitted into the handgrip 20, and a magazine cover 40 and a magazine 50 coaxially pivotally connected at respective rear end to the rear or handgrip end of the tacker case 30. The handgrip 20 internally defines a receiving space (not shown) for receiving the partial length of the tacker case 30 therein.

Figure 6:
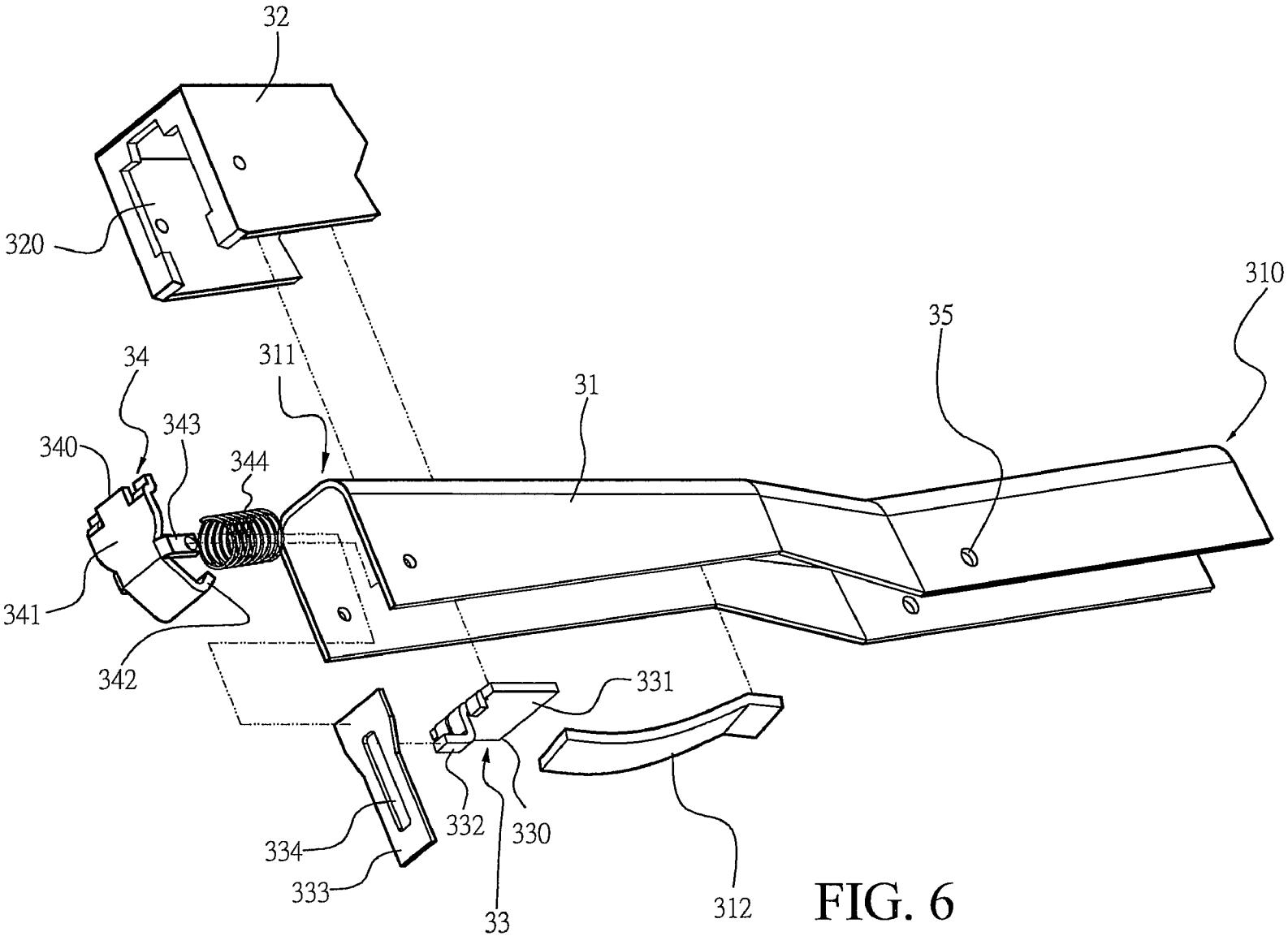
FIG. 6 is a fully exploded view of a tacker case for the hammer tacker of the present invention.

Please refer to FIG. 6. The tacker case 30 includes a case body 31 and a case body head cap 32. The case body 31 has a rear end 310, at where the partial length of the tacker case 30 is fixedly fitted into the receiving space of the handgrip 20; and a front end 311 internally provided with a striking member 33 for pushing against staples. A leaf spring 312 is provided in the case body 31 near a central portion thereof. The case body head cap 32 is connected to and encloses the front end 311 of the case body 31, and defines an opening structure 320 at one end thereof corresponding to the front end of the case body 31. A retaining push member 34 is mounted to the opening structure 320 of the case body head cap 32 to bear against the striking member 33.

In the illustrated preferred embodiment, the striking member 33 includes a locating plate 330 for connecting to the case body 31 and the case body head cap 32, and a striking plate 333 engaged with and held to the locating plate 330. The locating plate 330 includes a mount section 331 adjacent and locked to the case body 31, and a stop section 332 located at a front end of the mount section 331. The striking plate 333 is internally provided with a limiting slot 334, through which the stop section 332 of the locating plate 330 is forward extended.

In the preferred embodiment, the retaining push member 34 includes a retaining push plate 340 and a first elastic element 344 having two ends separately pressed against the retaining push plate 340 and the striking member 33. The retaining push plate 340 has a push section 341, at an inner side thereof one end of the first elastic element 344 is pressed against the retaining push plate 340 and at an outer side thereof a user can push. A lower end of the push section 341 is extended to form a hook section 342 for correspondingly hooking to a front end of the magazine 50. The push section 341 is provided at two lateral sides with a mounting bracket 343 each for connecting to the case body head cap 32. In an operable embodiment, the mounting brackets 343 are pivotally connected to the case body head cap 32 using a bolt.

Figure 7:
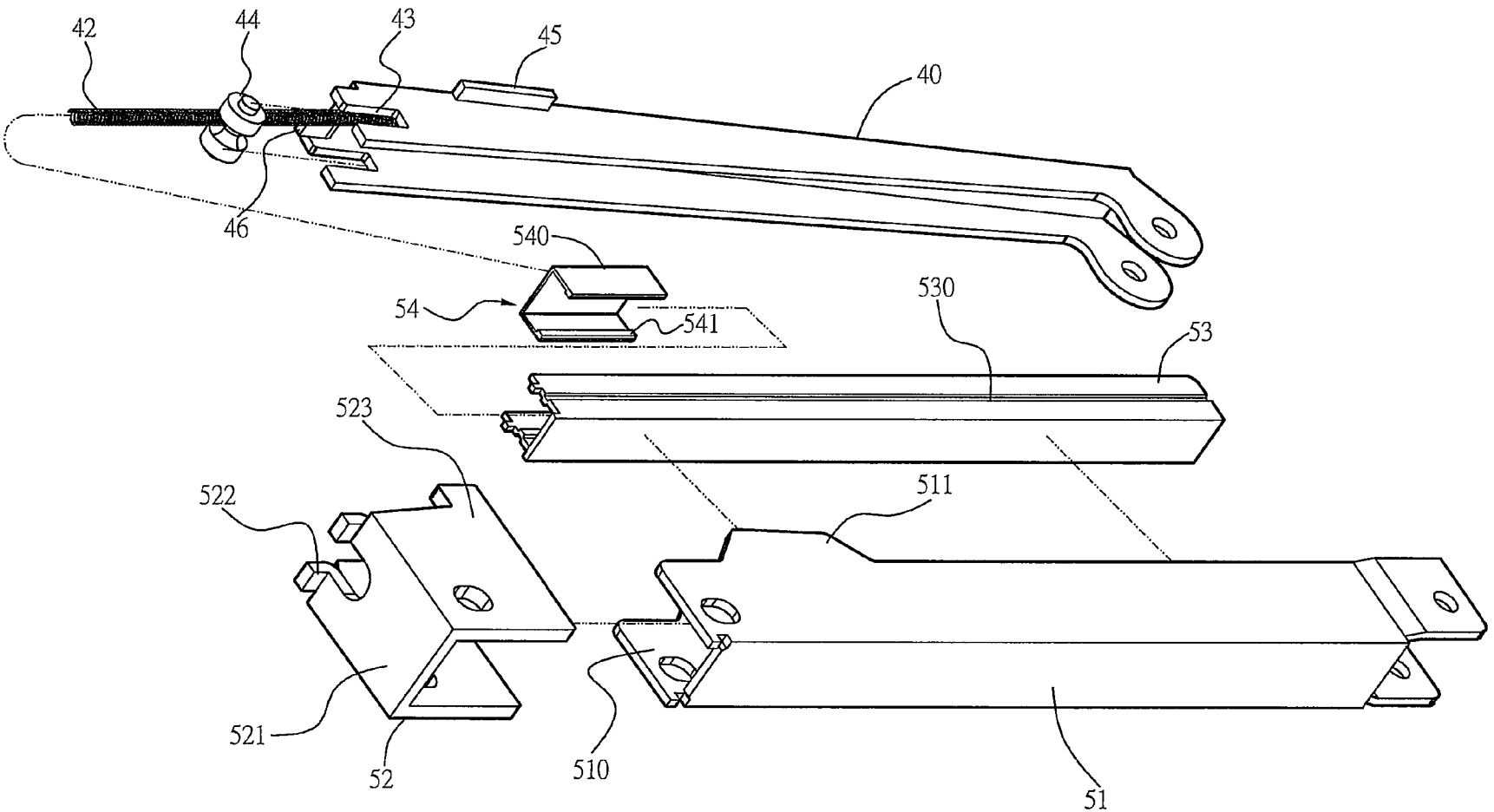
FIG. 7 is a fully exploded view showing a magazine cover and a magazine for the hammer tacker of the present invention.
Figure 8:
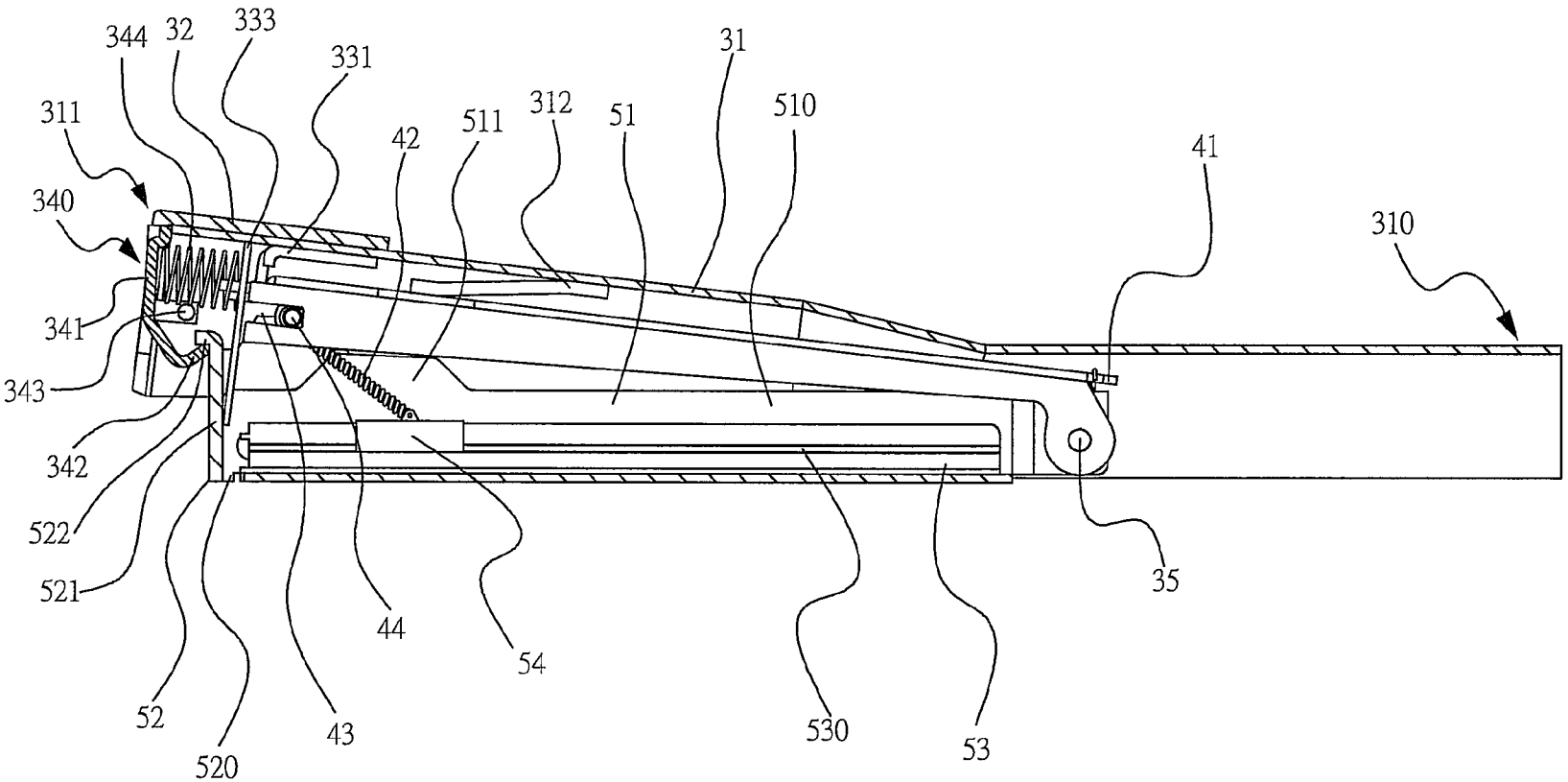
FIG. 8 is a sectional view of FIG. 4.
Figure 9:
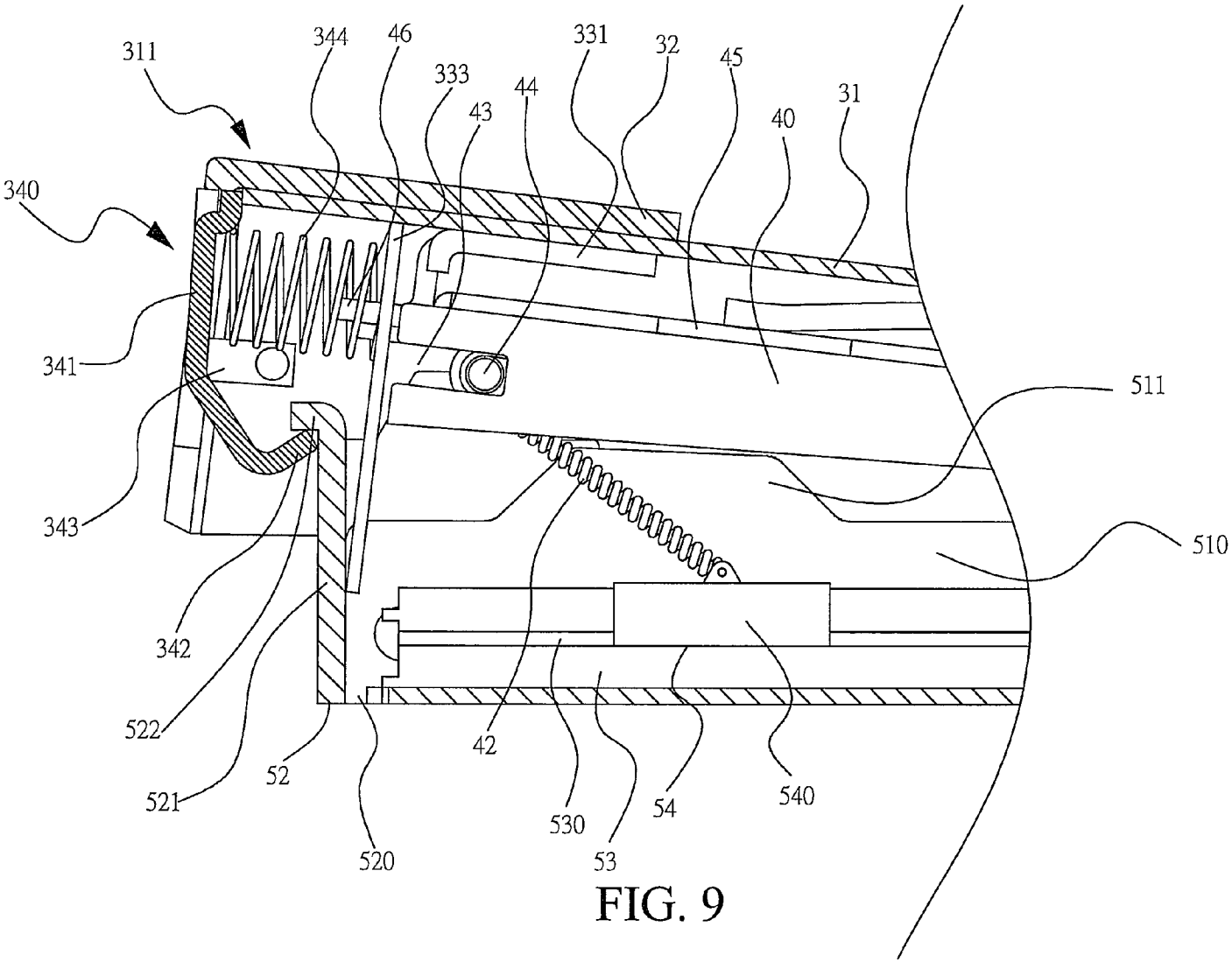
FIG. 9 is a fragmentary enlarged sectional view according to FIG. 8.

As shown in FIGS. 7 to 9, the magazine cover 40 is located inside the case body 31 to press against an end of the leaf spring 312 opposite to the case body 31. The magazine cover 40 is pivotally connected at the rear end to the rear or handgrip end of the tacker case 30 via a pivot pin 35. A front end of the magazine cover 40 is forward extended through and held to the striking member 33, which is located in the front end 311 of the case body 31.

In the illustrated preferred embodiment, the magazine cover 40 is provided at the rear end, which is pivotally connected to the handgrip end of the tacker case 30 via the pivot pin 35, with a holding section 41 (see FIG. 8), to which an end of a second elastic element 42 is connected. The magazine cover 40 is provided at the front end with a forward projected insertion section 46, which is extended through and confined in the limiting slot 334 of the striking plate 333.

The magazine cover 40 is symmetrically provided at the front end with a pair of rearward extended locating slots 43, across which a pin 44 is extended for supporting the second elastic element 42 thereat. The magazine cover 40 is further provided at two lateral sides at predetermined positions with a pair of sidewardly outward extended pressure receiving sections 45. The other end of the second elastic element 42 passes the pin 44 to connect to the magazine 50. With the two ends of the second elastic element 42 being subjected to pulling stress, the pin 44 is slid to locate at an inner bottom of the locating slots 43.

The magazine 50 has a rear end, which and the rear end of the magazine cover 40 are coaxially pivotally connected to the rear or handgrip end of the tacker case 30 via the pivot pin 35. And, the front end of the magazine 50 is provided with a catch section 522, to which the retaining push member 34 can correspondingly hook. In the illustrated preferred embodiment, the magazine 50 includes an outer staple channel 51, an outer staple channel head cap 52, an inner staple channel 53, and a slide unit 54.

The outer staple channel 51 and the magazine cover 40 are coaxially pivotally connected at respective rear end to the rear or handgrip end of the tacker case via the pivot pin 35. The outer staple channel 51 internally defines an elongated space 510 sized corresponding to the staples being used with the hammer tacker, and is provided at positions corresponding to the two pressure receiving sections 45 of the magazine cover 40 with two upward projected pressing sections 511.

The outer staple channel head cap 52 is connected to and encloses a front end of the outer staple channel 51 opposite to the handgrip 20, and cooperates with the outer staple channel 51 to define a staple feeding gap 520 between them. The outer staple channel head cap 52 includes a stopper section 521 corresponding to a front open end of the elongated space 510. The above-mentioned catch section 522 is located at an upper end of the stopper section 521 to forward extend therefrom for catching the hook section 342 of the retaining push plate 340. And, a connection section 523 is provided at two lateral sides of the stopper section 521 for correspondingly connecting to the outer staple channel 51.

In the preferred embodiment, the catch section 522 includes two forward projected lugs, to which the hook section 342 of the retaining push plate 340 hooks.

The inner staple channel 53 is received in the elongated space 510 defined in the outer staple channel 51, such that two narrow spaces (not shown) are formed between two lateral walls of the inner staple channel 53 and two lateral walls of the outer staple channel 51. Two slide ways 530 are symmetrically formed on the outer face of the two lateral walls of the inner staple channel 53.

The slide unit 54 is fitted on a top of the inner staple channel 53 received in the elongated space 510 of the outer staple channel 51, and is connected to the other end of the second elastic element 42. The slide unit 54 includes a drive section 540 configured corresponding to the staples being used with the hammer tacker, and two rails 541 provided along two lower inner edges of the drive section 540. The rails 541 are slidably engaged with the two slide ways 530 to limit the drive section 540 to displace along the slide ways 530. Under the pulling stress of the second elastic element 42, the rails 541 are brought to displace horizontally in the slide ways 530.

Figure 10:
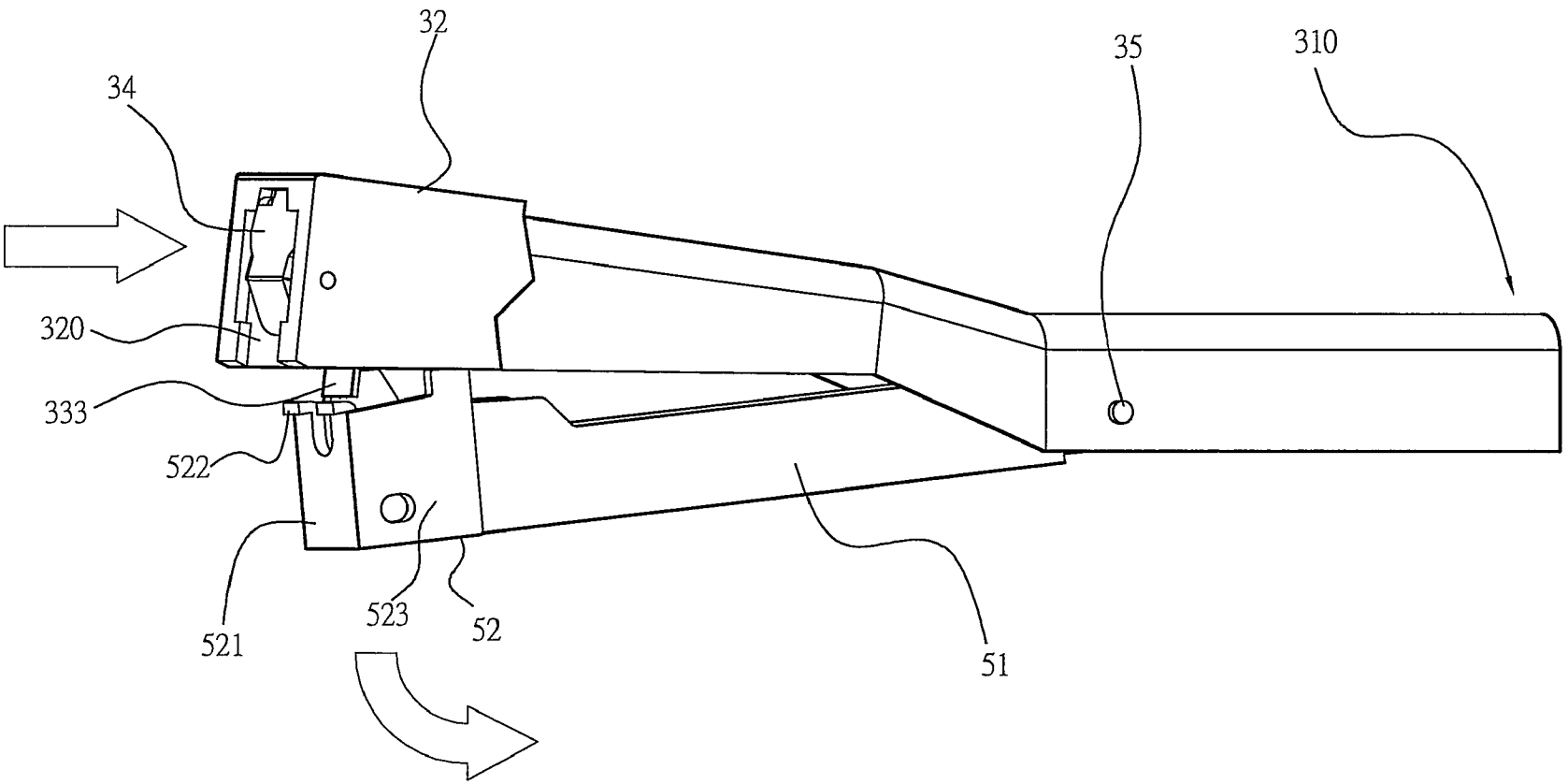
FIG. 10 shows the manner of pushing and opening the hammer tacker of the present invention.
Figure 11:
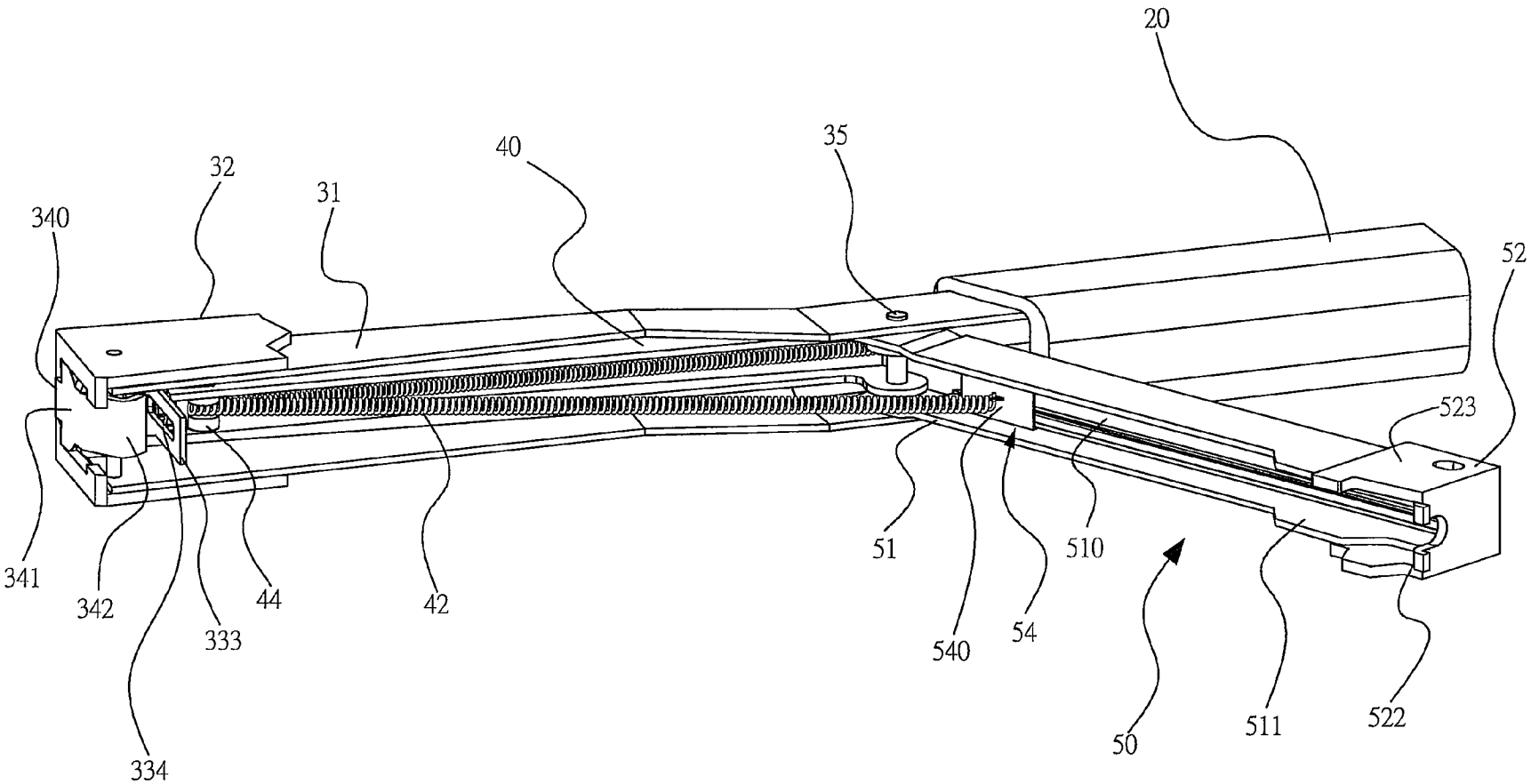
FIG. 11 shows the hammer tacker of the present invention in a fully opened state.
Figure 12:
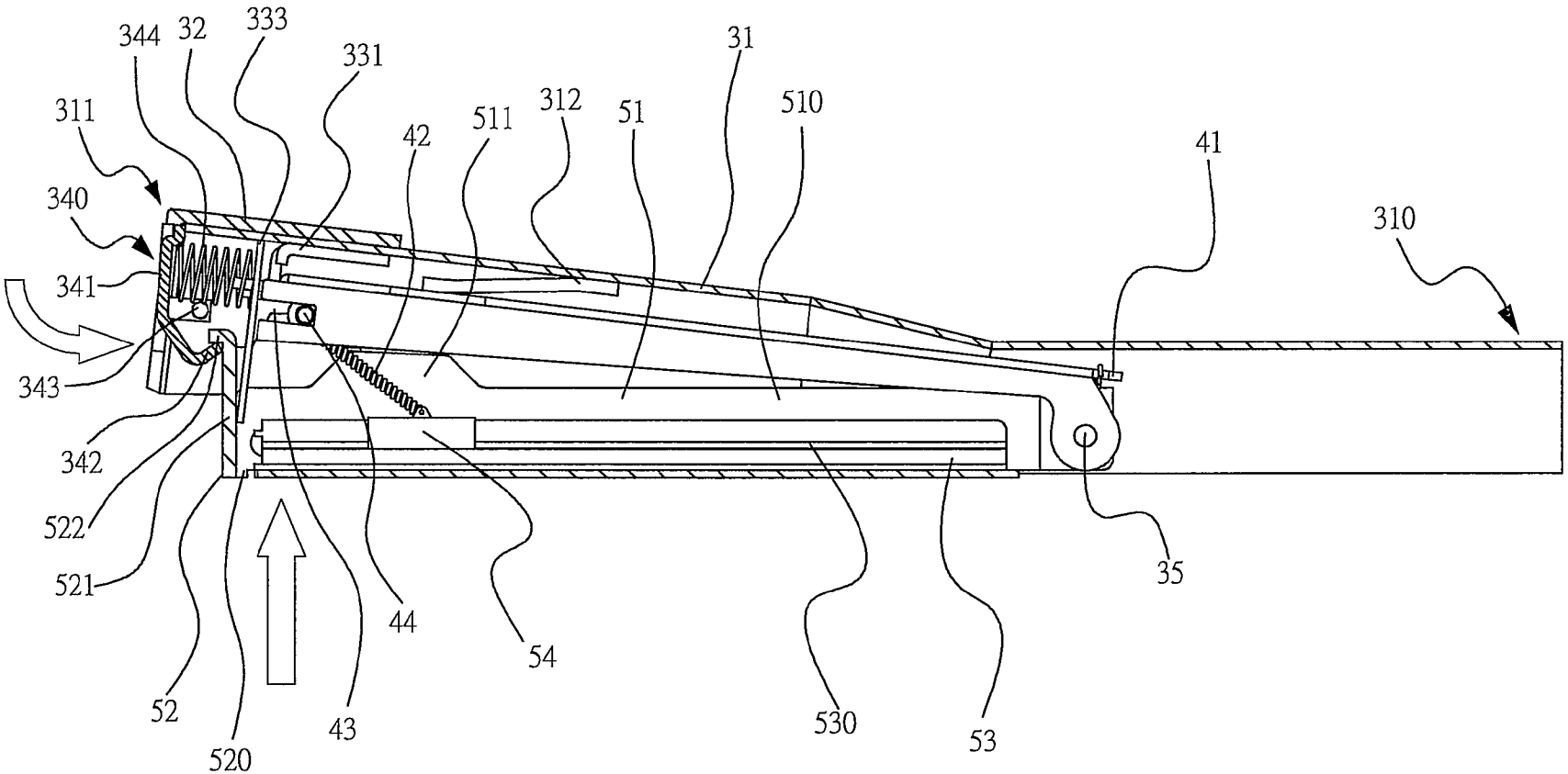
FIG. 12 is a sectional view showing the manner of closing the hammer tacker of the present invention.

Please refer to FIGS. 10 to 12. To load staples onto the hammer tacker of the present invention, first push the retaining push plate 340 at the push section 341. At this point, the hook section 342 at the lower end of the retaining push plate 340 is pivotally turned about the mounting brackets 343 to disengage from the catch section 522 on the outer staple channel head cap 52. Then, pivotally turn the magazine 50 outward by 90 degrees, and the second elastic element 42 automatically pulls the slide unit 54 to a rearmost end of the slide ways 530. At this point, the staples can be loaded on the top of the inner staple channel 53 that is received in the elongated space 510 of the outer staple channel 51, and the magazine 50 is then inwardly pivotally turned by 90 degrees. At this point, the slide unit 54 is guided by a pulling stress of the second elastic element 42 to slide forward and accordingly drives the loaded staples forward to press against the stopper section 521 of the outer staple channel head cap 52. Finally, apply a force to push the magazine 50 toward the tacker case 30, bringing the hook section 342 of the retaining push plate 340 to hook to the catch section 522 of the outer staple channel head cap 52 and thereby hold the front end of the magazine 50 to the tacker case 30.

In brief, in the present invention is characterized in that the tacker case includes the case body and the case body head cap, and the case body head cap defines the opening structure for the retaining push member to mount thereto; and that the magazine is provided at the front end with the catch section for engaging with the retaining push member; and that the catch section can be disengaged from the retaining push member to release the front end of the magazine from the tacker case simply by pushing the retaining push member. Therefore, the hammer tacker can be more conveniently and easily operated to open the magazine for loading staples with only one hand.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A magazine front end retaining structure for hammer tacker, the hammer tacker including a handgrip, a tacker case having a case body, a rear end of which having a partial length fixedly fitted into a receiving space of the handgrip, a magazine cover, and a magazine; the magazine cover and the magazine being coaxially pivotally connected at respective rear end to the rear end of the case body near the handgrip; the magazine front end retaining structure comprising:

a striking member being provided in the case body near a front end thereof; the magazine cover having a front end opposite to the handgrip being forward extended through and held to the striking member;

a case body head cap being connected to and enclosing the front end of the case body, and defining an opening structure at a front end thereof;

a retaining push member being mounted to the opening structure of the case body head cap to bear against the striking member; and a catch section being provided to a front end of the magazine opposite to the handgrip; and the retaining push member correspondingly hooking to the catch section to thereby retain the front end of the magazine to the tacker case.

2. The magazine front end retaining structure for hammer tacker as claimed in claim 1, wherein the striking member includes a locating plate for fixedly connecting to the case body and the case body head cap, and a striking plate engaged with and held to the locating plate.

3. The magazine front end retaining structure for hammer tacker as claimed in claim 2, wherein the locating plate includes a mount section adjacent and locked to the case body, and a stop section located at a front end of the mount section; and the striking plate is internally provided with a limiting slot, through which the stop section of the locating plate is forward extended.

4. The magazine front end retaining structure for hammer tacker as claimed in claim 1, wherein the retaining push member includes a retaining push plate and a first elastic element, and the first elastic element having two ends separately pressed against the retaining push plate and the striking member.

5. The magazine front end retaining structure for hammer tacker as claimed in claim 4, wherein the retaining push plate has a push section, at where one end of the first elastic element is pressed against the retaining push plate; the push section having a lower end being extended to form a hook section, and being provided at two lateral sides with two mounting brackets for connecting to the case body head cap.

6. The magazine front end retaining structure for hammer tacker as claimed in claim 1, wherein the case body is internally provided near a central portion thereof with a leaf spring, and an end of the leaf spring opposite to the case body being pressed against a top of the magazine cover.

7. The magazine front end retaining structure for hammer tacker as claimed in claim 1, wherein the magazine cover is provided at the rear end with a holding section, to which an end of a second elastic element is connected; the magazine cover being provided at the front end with a forward projected insertion section, which is extended through and confined in the striking member; a pin being extended across the front end of the magazine cover behind the projected insertion section; another end of the second elastic element passing the pin to connect to the magazine; and the magazine cover being further provided at each of two lateral sides with a sidewardly outward extended pressure receiving section.

8. The magazine front end retaining structure for hammer tacker as claimed in claim 7, wherein the magazine includes an outer staple channel, an inner staple channel received in the outer staple channel, an outer staple channel head cap connected to and enclosing a front end of the outer staple channel opposite to the handgrip for catching the retaining push member and thereby being held in place by the retaining push member, and a slide unit fitted on a top of the inner staple channel received in the outer staple channel and connected to the other end of the second elastic element.

9. The magazine front end retaining structure for hammer tacker as claimed in claim 8, wherein the outer staple channel and the magazine cover are coaxially pivotally connected at respective rear end to the rear end of the case body; the outer staple channel internally defining an elongated space sized corresponding to staples being used with the hammer tacker, and being provided at positions corresponding to the two pressure receiving sections of the magazine cover with two upward projected pressing sections;

the outer staple channel head cap being connected to and enclosing a front end of the outer staple channel opposite to the handgrip and cooperating with the outer staple channel to define a staple feeding gap between them; the outer staple channel head cap including a stopper section corresponding to a front open end of the elongated space, the catch section being located at an upper end of the stopper section to forward extend therefrom for catching the retaining push member; and a connection section provided at two lateral sides of the stopper section for correspondingly connecting to the outer staple channel;

the inner staple channel being received in the elongated space defined in the outer staple channel, such that two narrow spaces are formed between two lateral walls of the inner staple channel and two lateral walls of the outer staple channel; and two slide ways being symmetrically formed on an outer face of the two lateral walls of the inner staple channel; and the slide unit being fitted on a top of the inner staple channel received in the elongated space of the outer staple channel and connected to the other end of the second elastic element; the slide unit including a drive section configured corresponding to the staples being used with the hammer tacker, and two rails provided along two lower inner edges of the drive section; the rails being slidably engaged with the two slide ways to limit the drive section to displace along the slide ways; and, the rails being brought by a pulling stress of the second elastic element to displace horizontally in the slide ways.

10. The magazine front end retaining structure for hammer tacker as claimed in claim 9, wherein the catch section includes two forward projected lugs, to which the retaining push member hooks to hold the front end of the magazine to the tacker case.

* * * * *